US011963612B2

(12) United States Patent
Fifield et al.

(10) Patent No.: US 11,963,612 B2
(45) Date of Patent: Apr. 23, 2024

(54) BOOTH HAVING A BASE, A TABLE, A BENCH AND A SUPPORT LEG

(71) Applicant: BioFit Engineered Products, Inc., Bowling Green, OH (US)

(72) Inventors: Bruce Eric Fifield, Milan (IT); Christopher James Knox, Milan (IT); Daniela Sol Biasi Burzichelli, Varese (IT); John Beloved DeVriendt, Bowling Green, OH (US); Gary Donald Golichowski, Russia, OH (US)

(73) Assignee: BioFit Engineered Products, Inc., Bowling, Green, OH (US)

( * ) Notice: Subject to any disclaimer, the term of this patent is extended or adjusted under 35 U.S.C. 154(b) by 25 days.

(21) Appl. No.: 17/713,335

(22) Filed: Apr. 5, 2022

(65) Prior Publication Data

US 2022/0322819 A1 Oct. 13, 2022

Related U.S. Application Data

(60) Provisional application No. 63/171,817, filed on Apr. 7, 2021.

(51) Int. Cl.
*A47B 3/14* (2006.01)
*A47B 83/02* (2006.01)

(52) U.S. Cl.
CPC ..... *A47B 3/14* (2013.01); *A47B 83/023* (2017.08)

(58) Field of Classification Search
CPC ..... A47B 3/14; A47B 83/023; A47B 87/002
USPC ..... 297/14
See application file for complete search history.

(56) References Cited

U.S. PATENT DOCUMENTS

| | | | | |
|---|---|---|---|---|
| 1,589,006 | A * | 6/1926 | Huddleston | A47B 83/045 297/147 |
| 1,949,404 | A * | 3/1934 | Bailey | A47B 83/045 297/147 |
| 4,270,794 | A * | 6/1981 | Lewis | A47C 9/06 297/14 |
| 6,772,699 | B1 | 8/2004 | Elliott | |
| 7,066,098 | B2 | 6/2006 | Blasen et al. | |
| 7,765,938 | B2 | 8/2010 | Piretti | |
| 7,845,290 | B2 | 12/2010 | Piretti | |
| 7,878,128 | B2 | 2/2011 | Watson et al. | |
| 8,091,488 | B2 | 1/2012 | Chirea et al. | |
| D660,025 | S | 5/2012 | Rivera, Jr. et al. | |
| 8,181,583 | B2 | 5/2012 | Rivera, Jr. et al. | |

(Continued)

FOREIGN PATENT DOCUMENTS

GB 1020663 * 2/1966

*Primary Examiner* — Milton Nelson, Jr.
(74) *Attorney, Agent, or Firm* — Schaffer, Schaub & Marriott, Ltd.

(57) ABSTRACT

The booth has a base and a table is pivotably connected to the base. The table is movable from a stored positioned adjacent the base an in-use position where the table is positioned substantially perpendicular to the base. At least one bench is pivotably connected to the base. The at least one bench is movable from a stored position adjacent the base, an in-use position that is substantially perpendicular to the base. A support leg is pivotably connected to the table and to the at least one bench. The support leg is disposed to extend in a direction perpendicular to the table and the at least one bench when the table and at least one bench are in the in-use position.

25 Claims, 29 Drawing Sheets

(56) References Cited

U.S. PATENT DOCUMENTS

| | | | |
|---|---|---|---|
| 8,820,826 | B2 | 9/2014 | Dickey et al. |
| 9,226,572 | B2 | 1/2016 | Lai et al. |
| 9,265,340 | B2 | 2/2016 | Krusin et al. |
| 9,370,265 | B2 | 6/2016 | Whittington |
| 9,615,665 | B2 | 4/2017 | Whittington et al. |
| 9,738,116 | B1 | 8/2017 | Rivera, Jr. et al. |
| 9,980,583 | B2 | 5/2018 | Rivera, Jr. et al. |
| 10,174,515 | B1 | 1/2019 | Krivens |
| 10,375,062 | B2 | 8/2019 | Rivera, Jr. et al. |
| RE47,955 | E | 4/2020 | Rivera et al. |

* cited by examiner

BOOTH HAVING A BASE, A TABLE, A BENCH AND A SUPPORT LEG

CROSS-REFERENCE

The present patent application is based upon and claims the benefit of provisional patent No. 63/171,817, filed Apr. 7, 2021.

BACKGROUND OF THE INVENTION

The invention is directed to a booth having a table and at least one bench positioned adjacent to the table. The booth is designed to be used in seating arrangements such as a cafeteria or other uses where people want to sit adjacent to a table. Prior booth applications have generally utilized fixed benches that are positioned adjacent the table surface. The prior booths take up a significant area of space and are not easily moved or stored if it is desirable to reconfigure the space where the booths are located. The table and bench of the present invention are pivotably connected to a back panel and/or base frame can be positioned to be adjacent the back panel when the booth is not in use. The back panel and/or base frame is supported on casters to allow the booth to be easily moved when the booth is in the storage position. This configuration for the booth increases the flexibility of the uses that can be made for the booth and the space where the booth is located.

SUMMARY OF THE INVENTION

The booth has a base and a table is pivotably connected to the base. The table is movable from a stored positioned adjacent the base an in-use position where the table is positioned substantially perpendicular to the base. At least one bench is pivotably connected to the base. The at least one bench is movable from a stored position adjacent the base, an in-use position that is substantially perpendicular to the base. A support leg is pivotably connected to the table and to the at least one bench. The support leg is disposed to extend in a direction perpendicular to the table and the at least one bench when the table and at least one bench are in the in-use position.

DETAILED DESCRIPTION OF THE INVENTION

Figure 1:
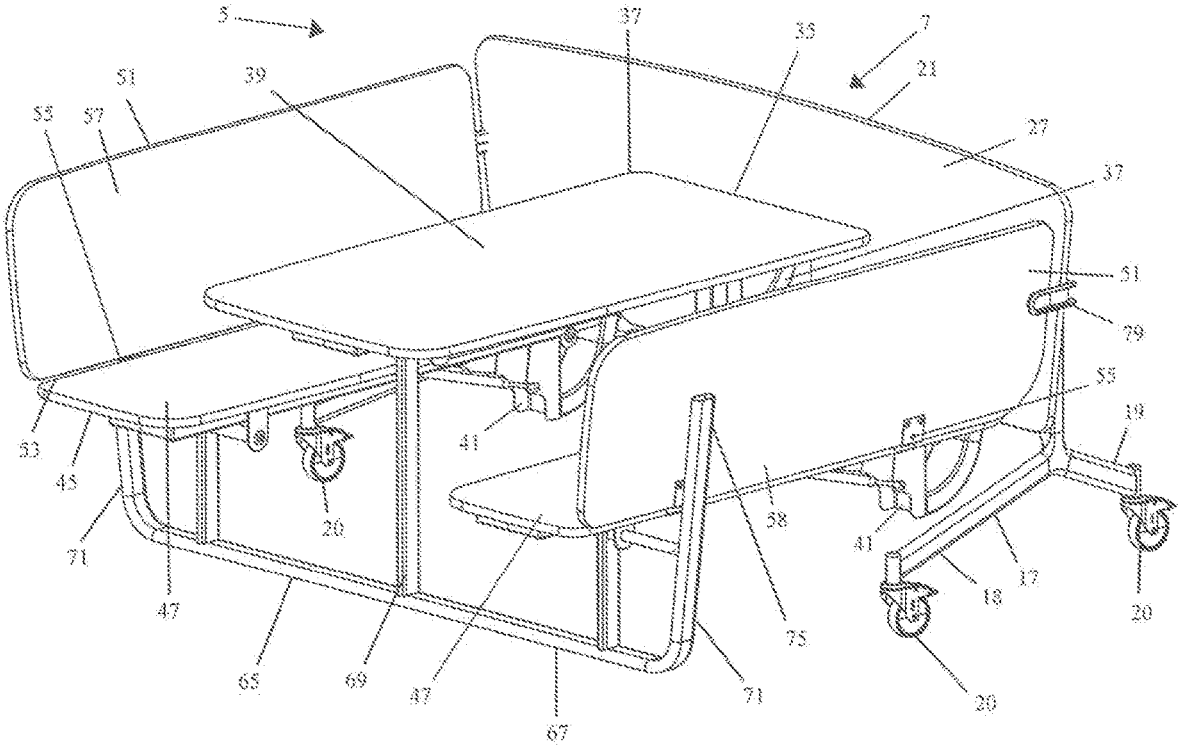
FIG. 1 is a perspective view of the booth of the present invention.
Figure 2:
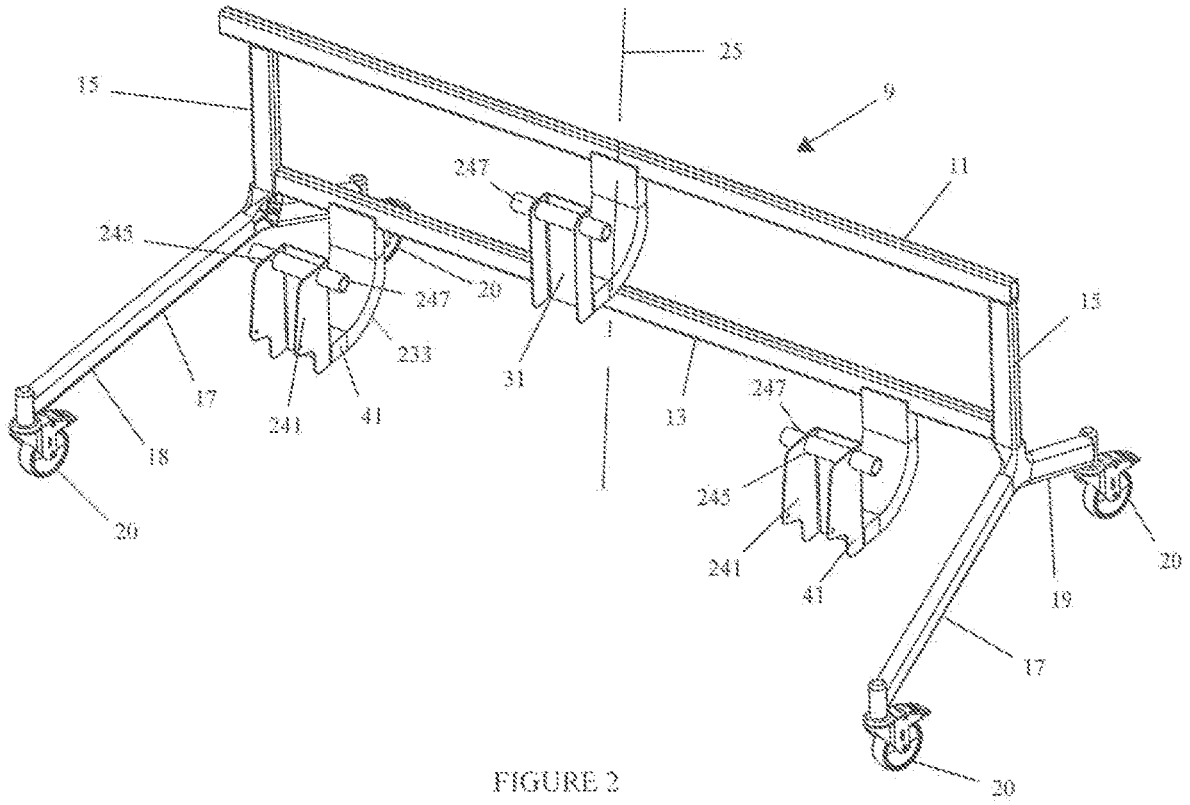
FIG. 2 is a perspective view of the base frame.
Figure 3:
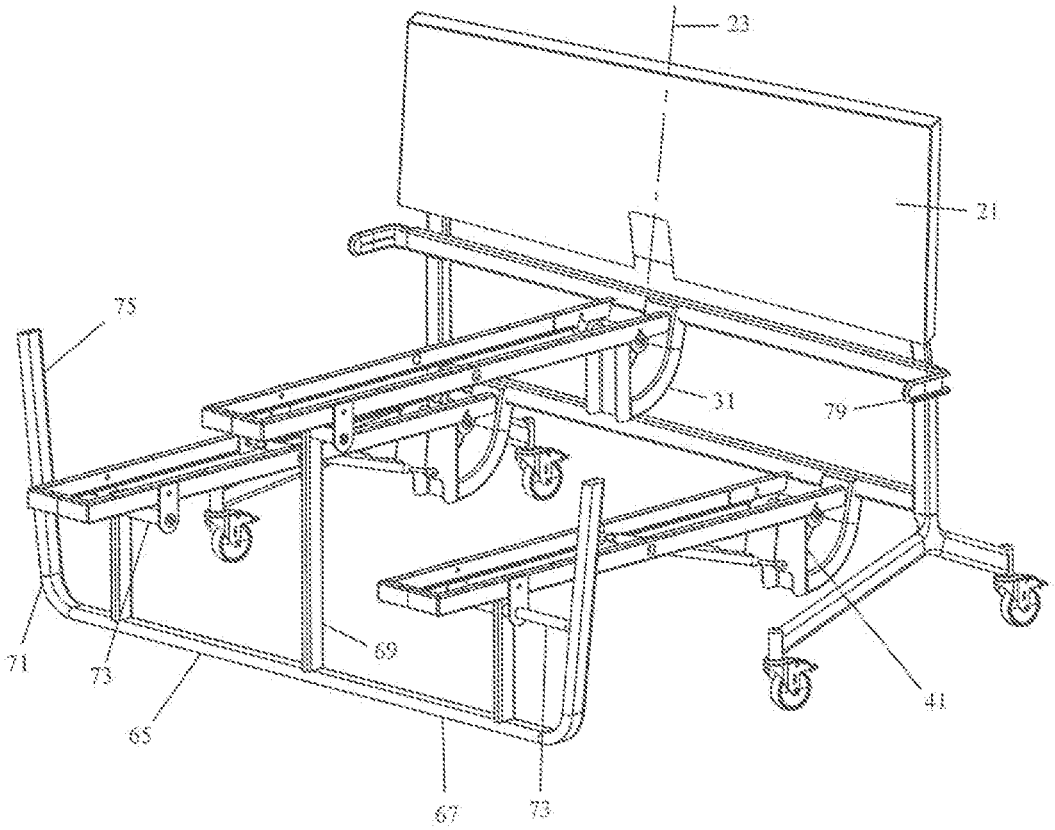
FIG. 3 is a partial perspective view of the booth.
Figure 4:
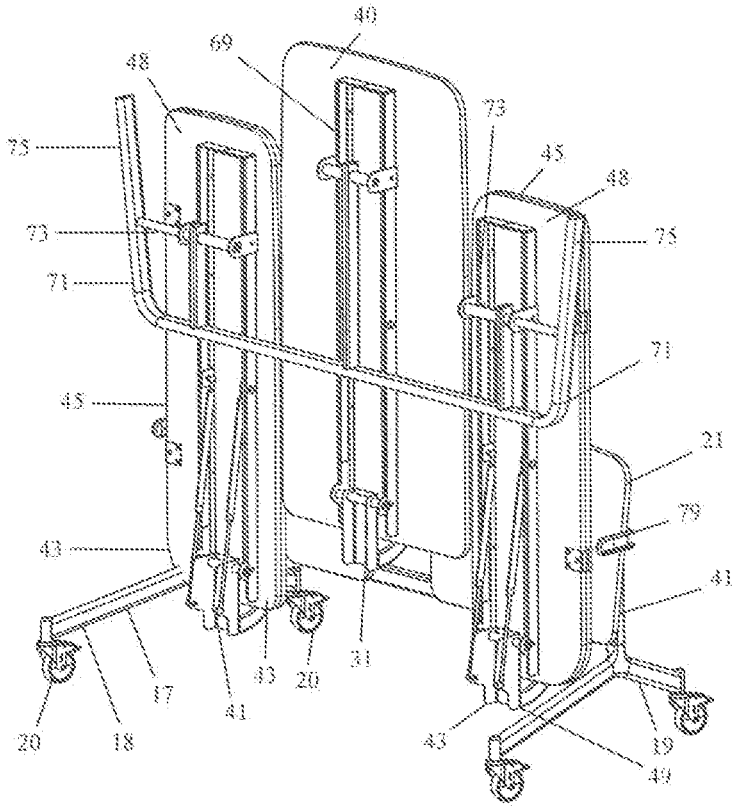
FIG. 4 is a perspective view of the booth in the storage position.
Figure 5:
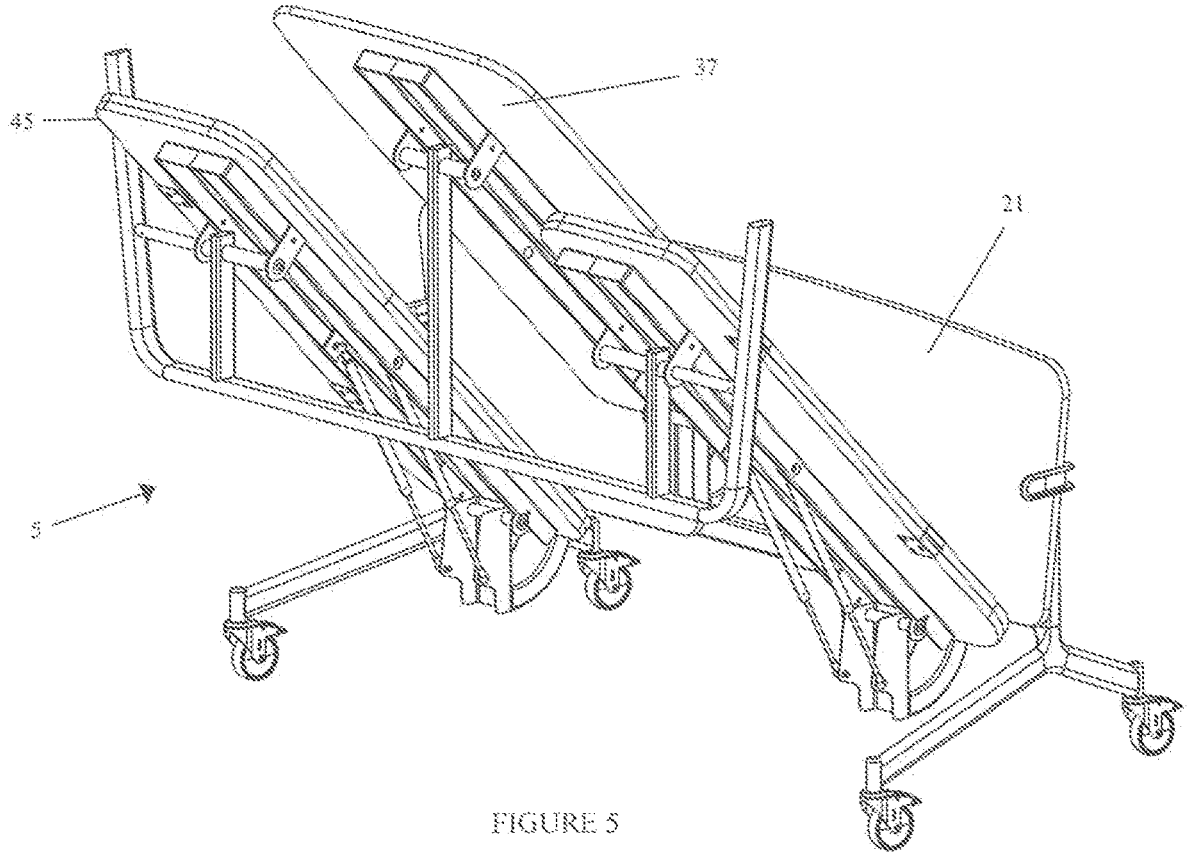
FIG. 5 is a perspective view of the booth in a partially folded position.
Figure 6:
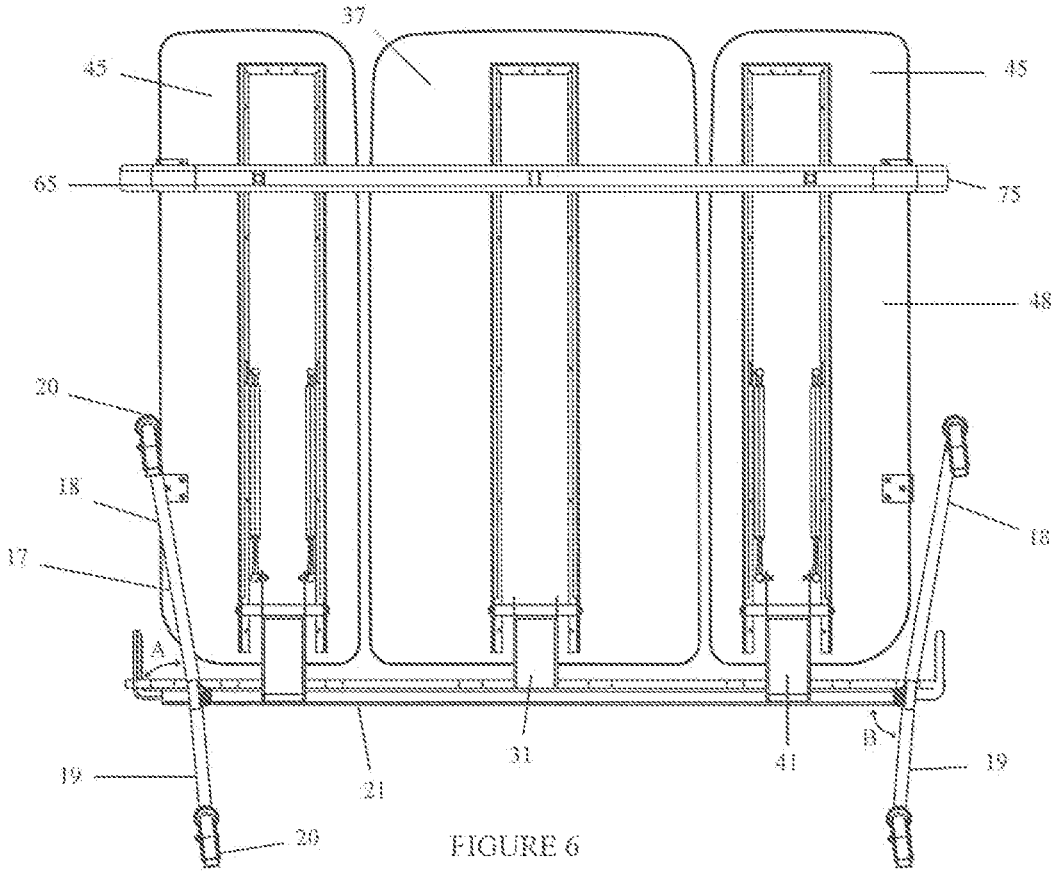
FIG. 6 is a bottom view of the booth of the present invention.

The patent application of the present invention is directed to a booth that can be used for a variety of applications. The booth has a table, at least one seat and a base. The booth is designed so that it can be folded to a stored position when not in use. The features of the invention will be more readily understood by referring to the attached drawings in combination with the following description.

The booth 5, as shown in FIGS. 1-6, has a base 7. One option for the base is a base frame 9 having a top member 11, bottom member 13 and side members 15. The side members 15 are connected to the top member and bottom member. The top member is disposed to be substantially parallel with the bottom member and the side members are disposed to be in substantially parallel relationship. In most applications the top, bottom and side members are made of a tubular metal material such as steel or aluminum or cast aluminum, although other materials can be utilized if desired. A stabilization leg 17 is connected to each of the side members 15 at a positioned adjacent the bottom member 13. The stabilization legs are usually made of a tubular metal material such as steel or aluminum or cast aluminum, although other materials and non-tubular shapes can be utilized. Each stabilization leg has a first portion 18 that extends in a direction substantially perpendicular to the side leg and a second portion 19 that extends in the opposite direction substantially perpendicular to the side leg.

A back panel 21 is secured to the top member, bottom member, and side members on one side of the base frame 9. The back panel is usually made of a MDF board, particle board or wood, although other suitable materials can be used. A fabric or upholstered material can be placed on the back panel to assist in noise reduction. A white board can also be positioned on the back panel to allow users of the booth to display information on the back panel. In most applications, the back panel has a width and height that is greater than the width and height of the base frame, however, if desired the height and width of the panel can be the same as or less than that of the frame. The width of the base frame 9 is the distance between the side members 15 and the height of the base frame is the distance between the top member and bottom member. The width and height of the back panel 21 are taken in the same direction as the width and height for the base frame 9. In some applications the back panel is mounted in an offset orientation with respect to the base frame 9. The centerline 23 of the back panel is displaced from about 0.75 of an inch to about 5 inches from the centerline 25 of the base frame 9. The first surface 27 of the back panel is spaced apart from the base frame 9. As show in in FIG. 2, it is also possible to position one of the stabilization legs 17 in an offset position with respect to the centerline of the base frame 9. The stabilization leg on the left side of this figure is positioned in the offset position. The stabilization leg is offset from about 0.75 of an inch to about 5 inches from the position of the other stabilization leg's orientation with respect to the centerline of the base frame. Only one stabilization leg 17 needs to be positioned in this offset manner.

A table hinge 31 is positioned on the first surface 27 of the back panel and/or base frame. The table hinge is secured to the back panel and may also be secured to a support element on the base frame as shown and described in FIGS. 11 and 12 later in the description. The support element is connected to the top, bottom and/or side member of the base frame. A first end 35 of a table 37 is secured to the table hinge on the back panel and/or base frame. The table hinge 31 is disposed to allow the table to move from a storage position where the first side 39 of the table is positioned adjacent the back panel 21 and a use position where the table is positioned in a substantially perpendicular orientation to the first surface 27 of the back panel.

A bench hinge 41 is positioned on the first surface 27 of the back panel 21 and/or base frame on opposite sides of the table hinge 31. The bench hinges are secured to the back panel and may also be secured to a support element on the base frame. The support element is connected to the top, bottom and/or side members of the base frame as shown and described in FIGS. 11 and 12 later in the description. A first end 43 of a bench 45 is secured to each of the bench hinges. The bench hinges are disposed to allow the bench to move from a storage position where the first side 47 of the bench is positioned adjacent the first surface 27 of the back panel and/or base frame and a use position where the bench is positioned in a substantially perpendicular orientation to the first surface of the back panel.

A seatback 51 can be pivotably secured to a first edge 53 of each bench by at least one seat back hinge 55. The seatback hinge 55 is disposed to allow the seatback to move from a storage position where the first side 57 of the seatback is adjacent the first side 47 of the bench 45 and a use position where the first side of the seatback is positioned in a substantially perpendicular orientation to the first side of the bench. The table, at least one bench and seatback are disposed in a substantially vertical orientation when in the stored position and a substantially horizontal orientation when in the use position. In some applications, the seatback may not be used and is not attached to the bench.

Figure 22:
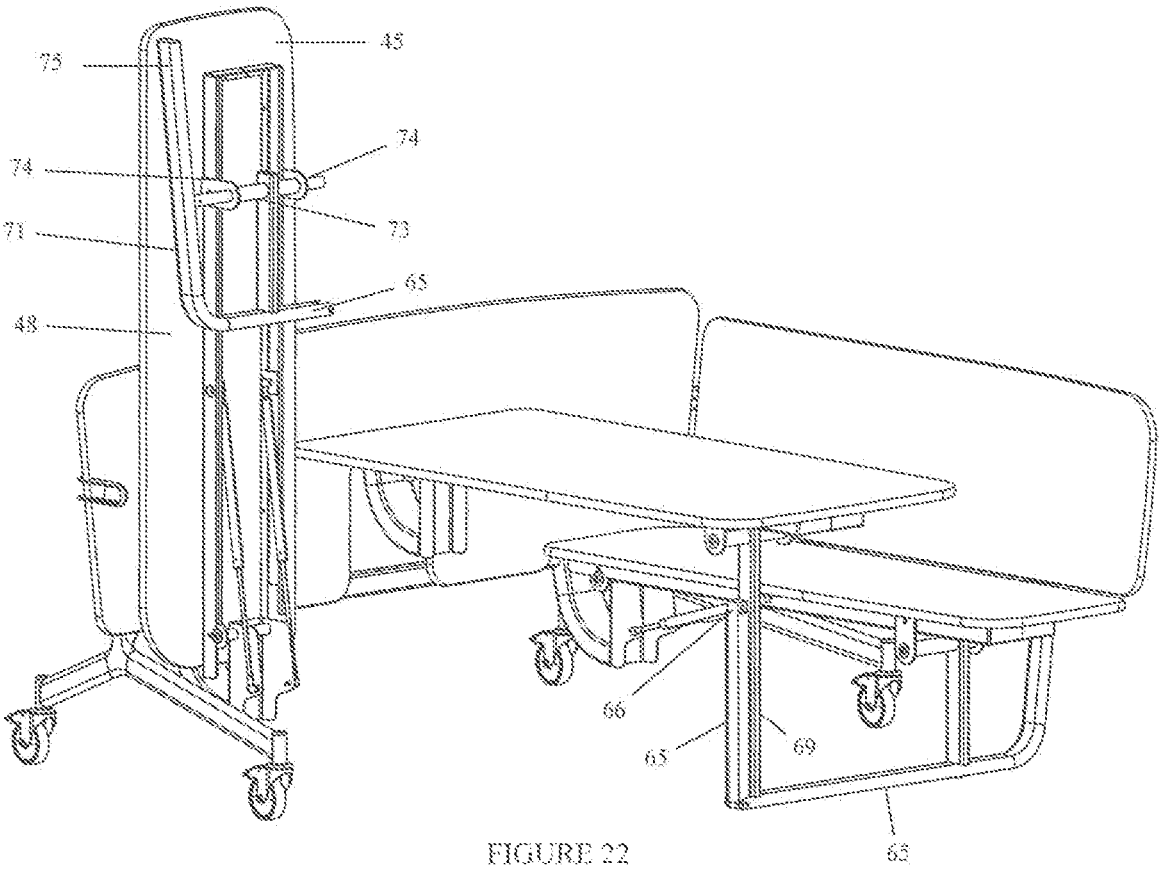
FIG. 22 is a perspective view of another feature of the booth.
Figure 23:
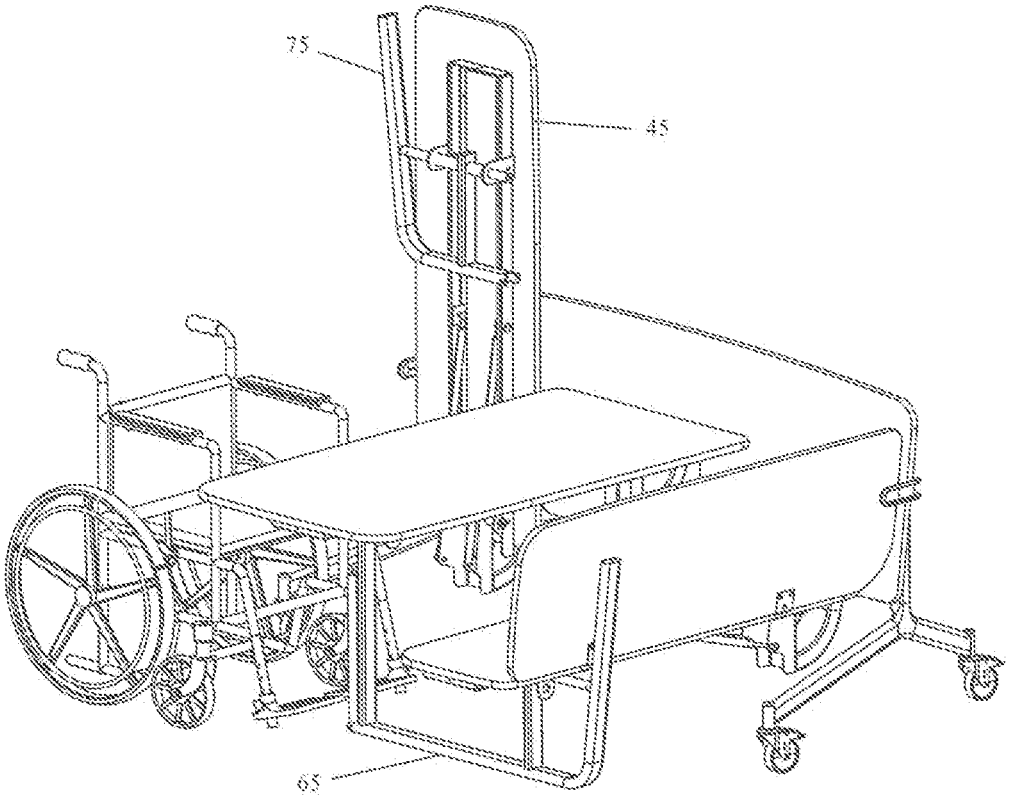
FIG. 23 is a perspective of the booth of FIG. 22.
Figure 24:
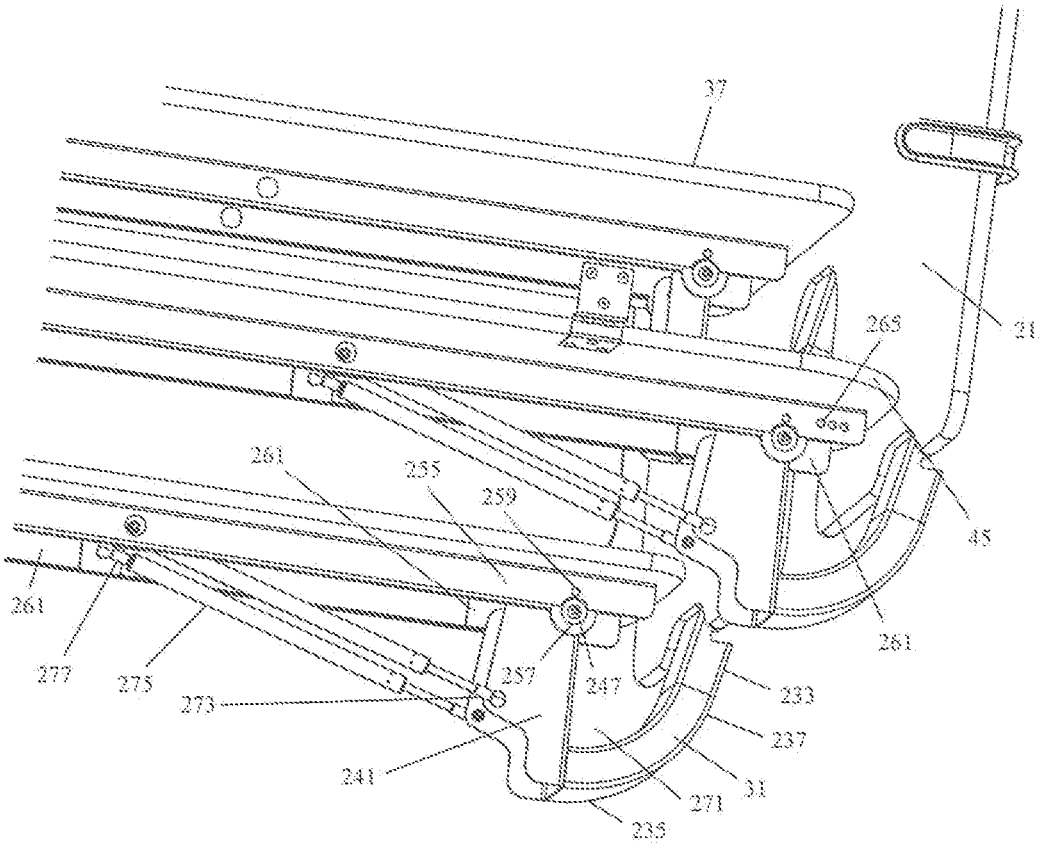
FIG. 24 is a partial perspective view of features of the booth.

A support leg 65 is pivotably connected to the second side 40 of the table 37 and the second side 48 of the bench 45. The support leg is connected to a part of the table and benches that is spaced apart from where the table and benches are pivotably connected to the back panel. The support leg has a base 67, a table leg 69 that is operatively connected to the table and a bench leg 71 that is operatively connected to each of the benches. As shown in FIGS. 22 and 23 the bench legs 71 are able to be connected/disconnected at the junction 66 in support leg 65 via a locking mechanism 66. Disengaging either of the bench legs 71 facilitates deployment of one bench 45 and table 37 to a use position where the one bench and table are positioned in a substantially perpendicular orientation to the first surface of the back panel. The other non-deployed bench 45 and seatback 51 remain stored in a substantially vertical orientation. This configuration allows wheelchair access to the booth pursuant to ADA requirements. A pivot member 73 extends from the bench leg along the second side 48 of the benches. The benches are pivotably connected to the pivot member by a bracket 74 or other suitable device. The support leg has a base 67 that is connected to the table leg and the bench leg. The base is spaced apart from where the support leg is pivotably connected to the table and the bench. The support leg is designed so that it can be moved from a storage position where the support leg is adjacent the second side of the table and benches and a use position where the support leg is positioned substantially perpendicular to the second side of the table and benches. An extension 75 of the bench leg 71 extends beyond the bench 45 in a direction towards the table 37. The extension 75 is disposed to engage the second side 58 of the seatback 51 when the seatback is in the use position. A flange 79 is positioned on the back panel 21 or the base frame 9 adjacent each seat back 51 and extends in a direction that is substantially perpendicular to the first surface 27 of the back panel. The flanges 79 are disposed to engage the second side 58 of a seatback 51 when the seatbacks are in the use position. The extension 75 and the flanges 79 are disposed to be in substantial alignment so that each device will maintain the seatback 51 in the proper use position.

The stabilization leg 17 has a first portion 18 that extends in a direction towards the table 37 and a second portion 19 that extends in a direction away from the table when the table is in the in-use position. The first portion of the stabilization leg has a length that is from about 30 percent to about 90 percent of the length of the table. The second portion of the stabilization leg has a length from about 20 percent to about 60 percent of the length of the table. The first portion of the stabilization leg is positioned at an angle A from about 55 degrees to about 90 degrees with a plane defined by the back panel. The second portion is positioned at an angle B from about 55 degrees to about 90 degrees with a plane defined by the back panel. The stabilization legs on opposite sides of the base frame 9 are positioned in a non-parallel relationship. In most applications, the first portion 18 extends in a direction away from the center line 23 of the back panel 21 and the second portion 19 extends in a direction towards the center line of the back panel. One of the stabilization legs 17 is usually positioned in an offset position with respect to the centerline of the base frame. This has the stabilization legs on opposite sides of the base frame spaced different distances from the centerline of the base frame. This unique positioning for the stabilization legs facilitates the positioning of the booths in a back to back relationship (see FIG. 9) and the nested for storage position without interference of the stabilization legs. A caster 20 is positioned on the end of the first and second portions that are spaced apart from the side members 15. The casters allow the booth 5 to easily be moved in the table and benches are in the stored position. A brake mechanism can be included on any of the casters to prevent the booth from moving when the booth is located in a desired position. The casters can also include a swivel feature if desired.

Figure 7:
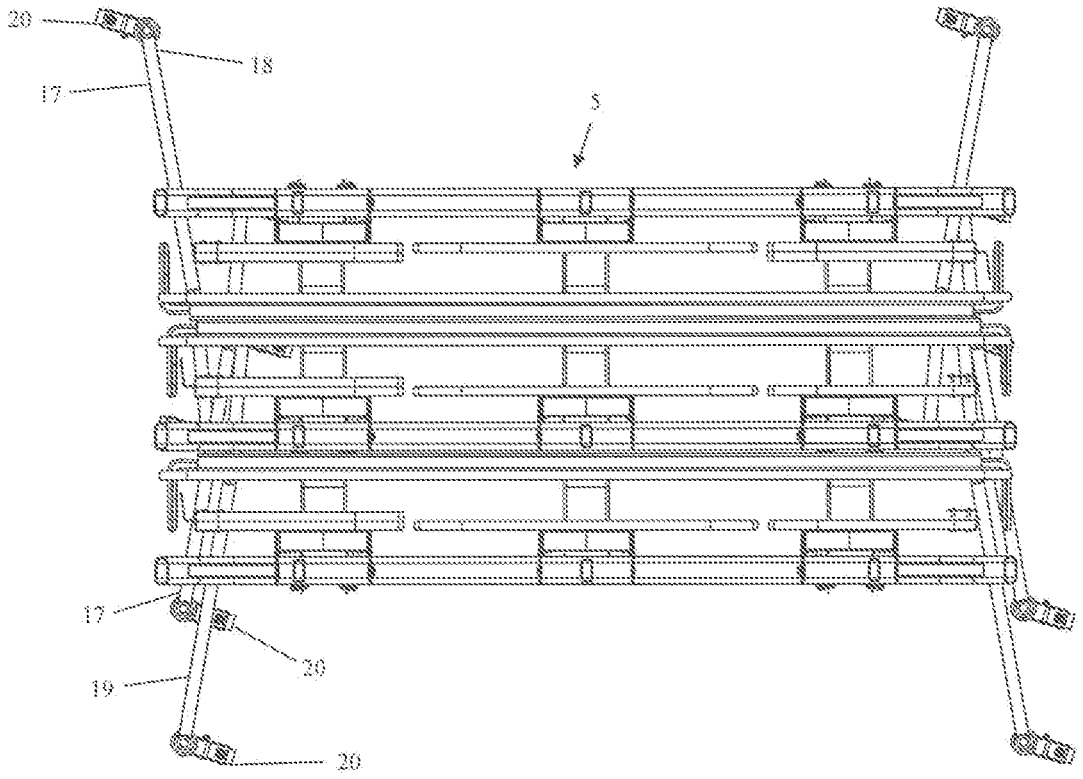
FIG. 7 is a top view of a plurality of booths in a stored position.
Figure 8:
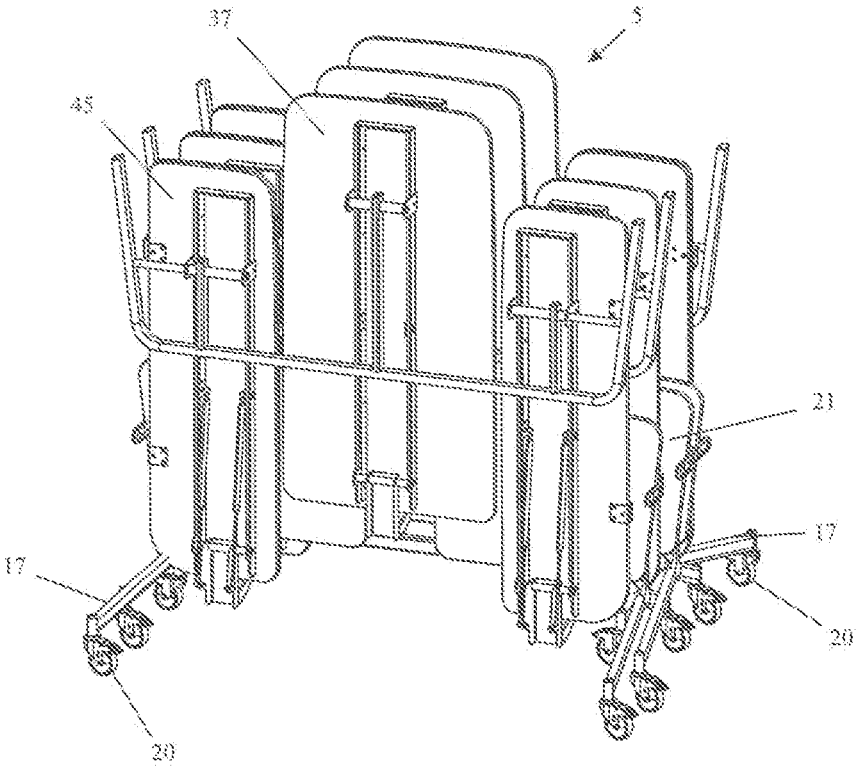
FIG. 8 is a perspective view of a plurality of booths in the stored position.

As shown in FIGS. 7 and 8 a plurality of booths 5 can be nested together when the table and benches, that are that part of the booth, are in the storage position. The vertical position of the table and benches adjacent the back panel in the stored position reduces the space required for the booth. This reduces the footprint for the booth and increases the uses for the booth and the space where the booth is located. The angular, non-parallel position of the stabilization legs 17 allow the booths to be stored in close proximity when in the storage position. Back panel 21, base frame 9 or stabilization legs 17, as previously described, can be disposed at an offset position to further enhance the ability of the booths to be stored in a very compact manner.

When it is desirable to use a booth 5, a booth can be moved from the storage location by rolling the booth on the casters 20 on the stabilization legs 17 attached to the base frame 9. When the booth is in the desired location the table 37 and benches 45 can be moved from the storage location adjacent the back panel 21 until the table and benches are oriented substantially perpendicular to the back panel. At the same time, the support leg 65 is advanced to a position where it is substantially parallel to the back panel 21. In this orientation for the support leg, the base 67 will engage a support surface which is usually the same support surface upon which the casters 20 are positioned. The support leg 65 provides support for the end of the table and benches that are spaced apart from the back panel when the booth is in the use position. The booths 5 can be arranged in a variety of orientations to provide the desired seating arrangements for the users of the booths.

Figure 9:
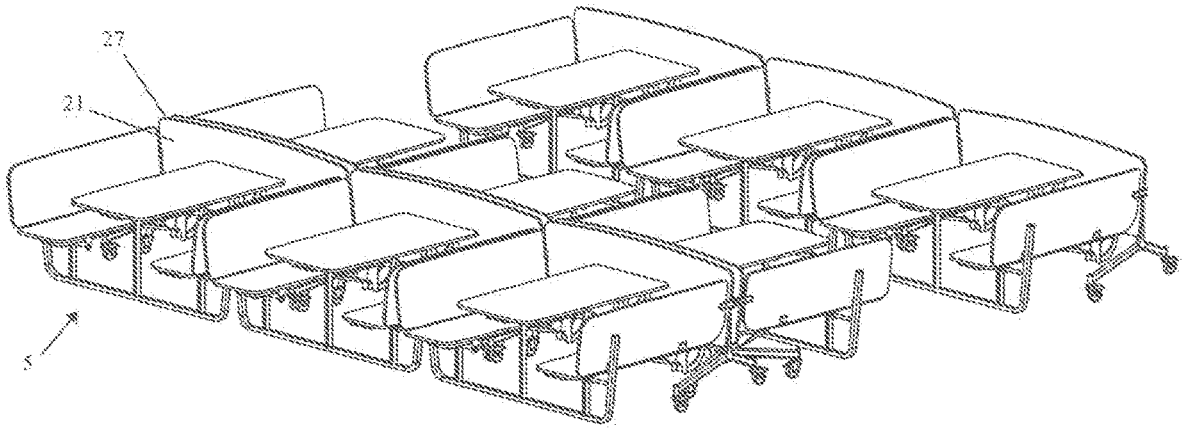
FIG. 9 is a perspective view of booths of the present invention disposed in a back-to-back arrangement.
Figure 10:
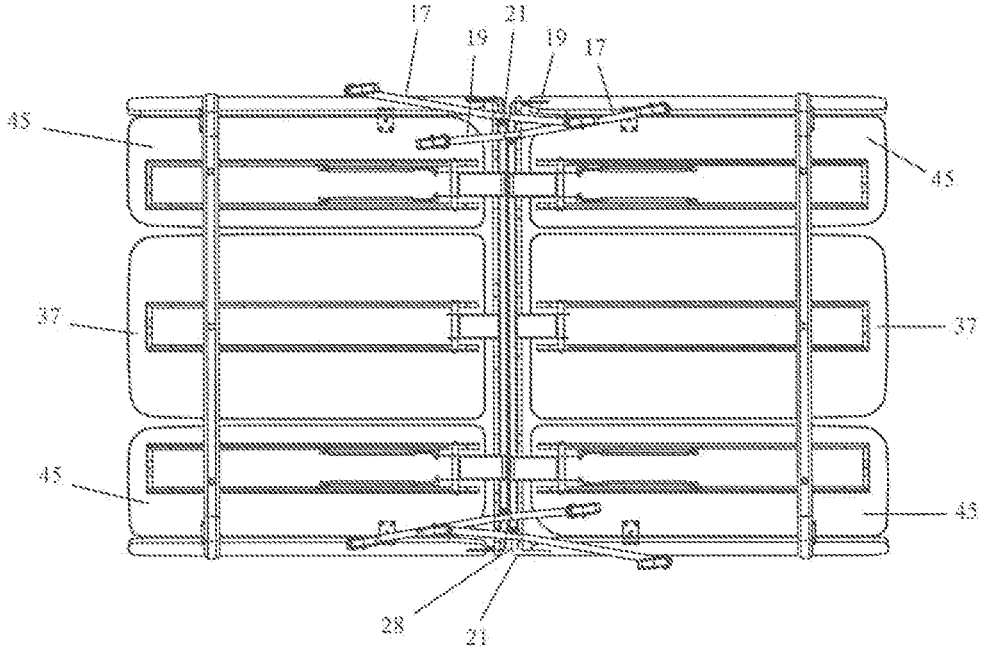
FIG. 10 is a bottom view of a pair of booths oriented in a back-to-back arrangement.

As shown in FIGS. 9 and 10 the angular position of the stabilization legs 17 also allow the booths to be positioned in a back-to-back arrangement where the second surfaces 28 of the back panels 21 are positioned adjacent to one another in the back-to-back positioning of the booths. The offset between the base frame 9, the back panel 21, or stabilization legs 17, described previously, allows the booths to have clearance for the stabilization legs while allowing the back panels to be in alignment.

Figure 11:
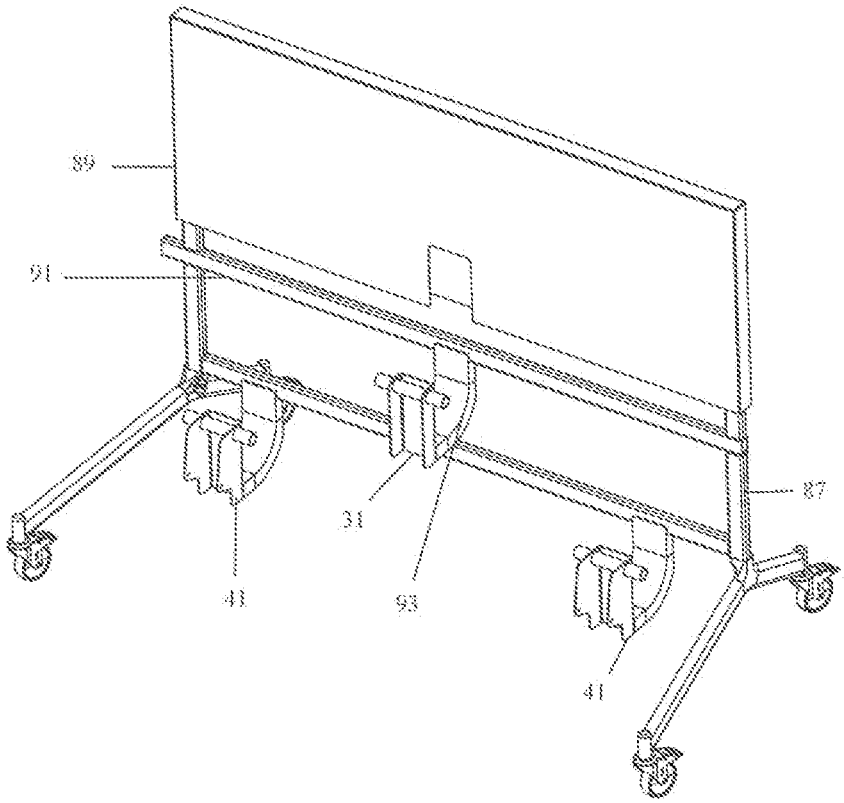
FIG. 11 is a perspective view of an alternative for the base frame and back panel of the booth.
Figure 12:
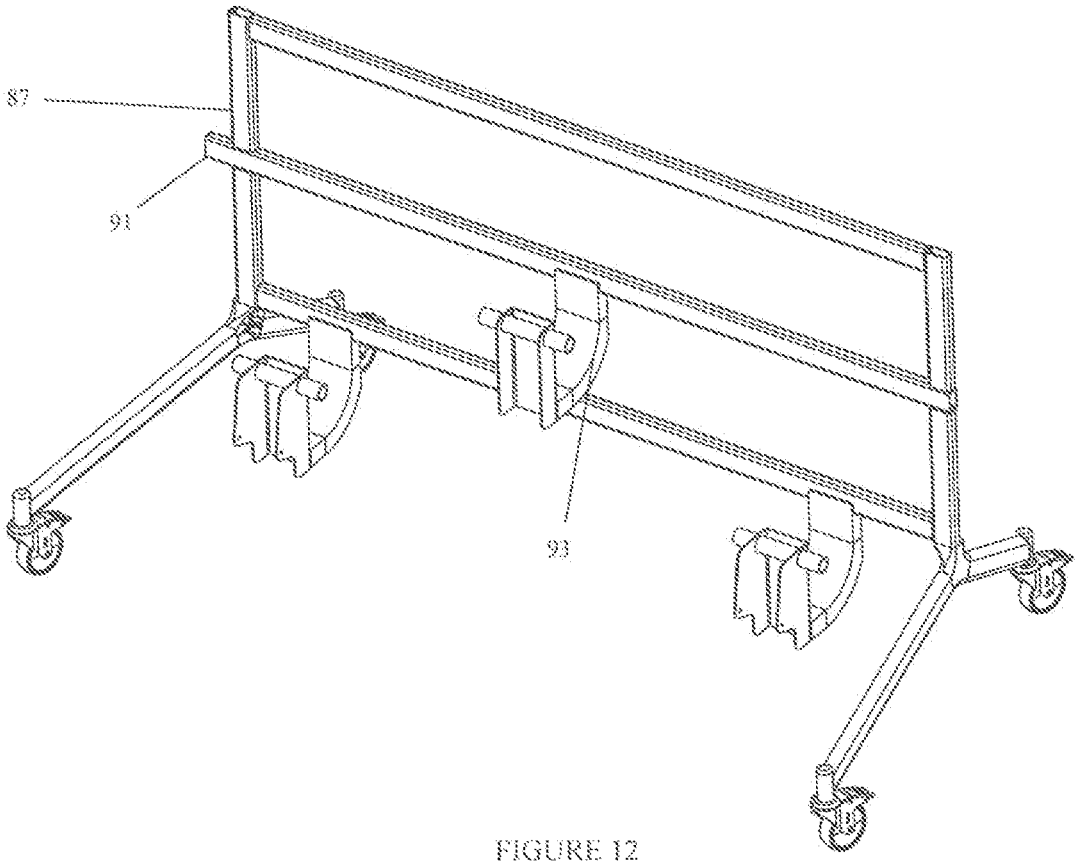
FIG. 12 perspective view of the base frame with the back panel as shown in FIG. 11.

As shown in FIGS. 11 and 12 the base frame 87 can be modified to be covered by a fabric material 89 or other similar material to create a different aesthetic appearance. In this configuration, two additional cross supports 91 for the bench hinges 41 and hinge support 93 for the table hinge 31 are added to the base frame to locate the hinges for the table and the benches that are used to pivotably connect these pieces to the base frame. The hinges for the table and benches function in the manner previously described. In this arrangement, the back panel is not utilized and the base frame functions as the base 7. In another configuration, as show in in FIG. 25, the base frame 87 can be used to provide the support for the bench and table hinges and a back panel 281 can be positioned on the base frame. The back panel will have a notch 283 to accommodate the table hinge that secures the table to the base frame as show in in FIG. 25.

Figure 13:
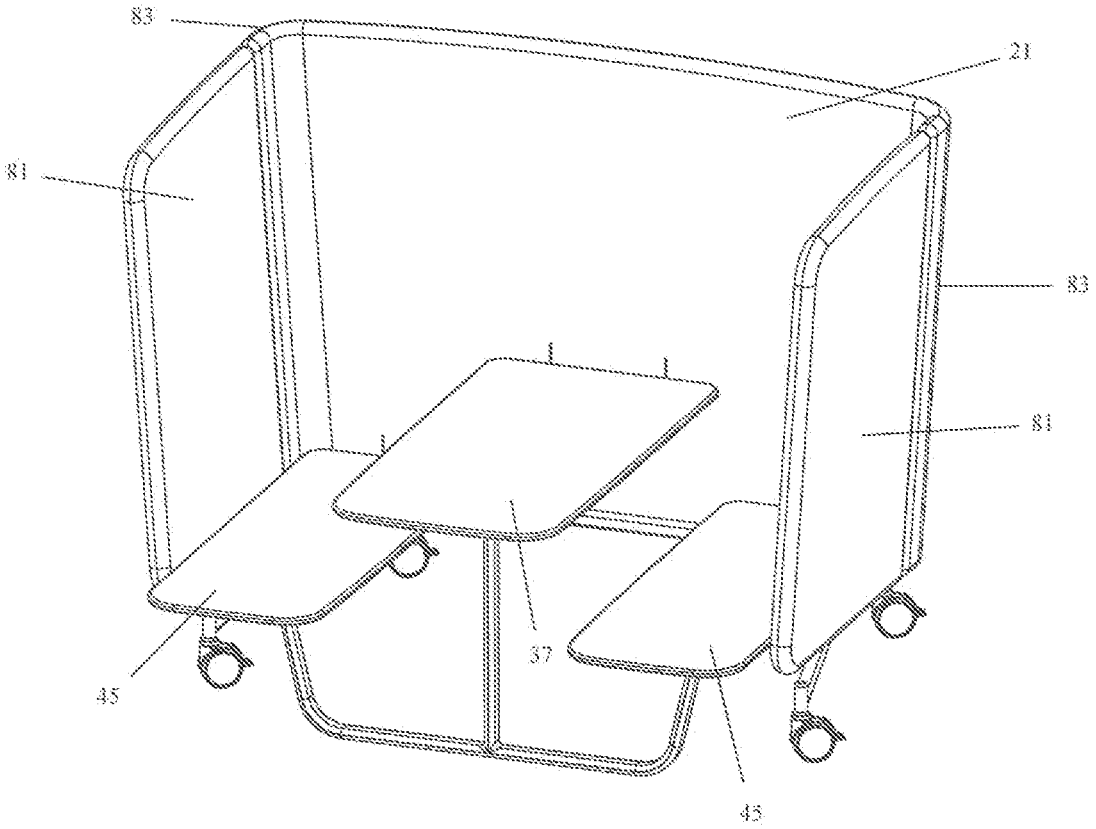
FIG. 13 is a perspective view of another arrangement that can be utilized for the seatbacks of the booth.
Figure 14:
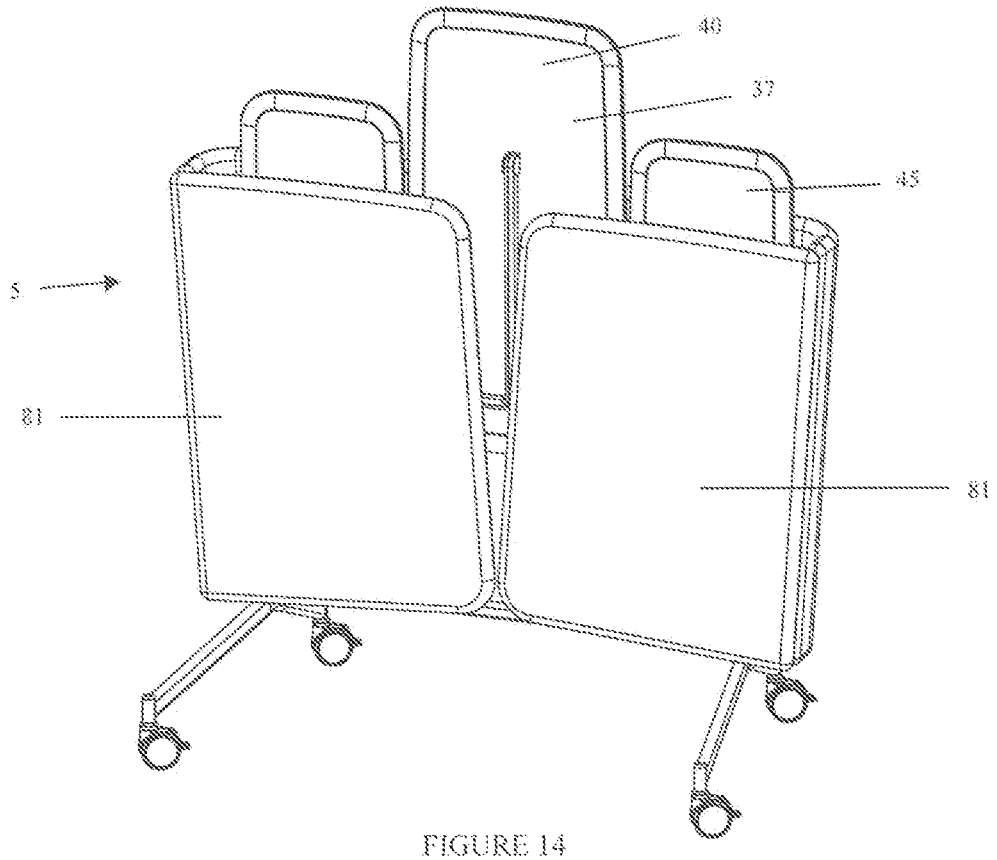
FIG. 14 is a perspective view of the booth of FIG. 13 in the storage position.
Figure 15:
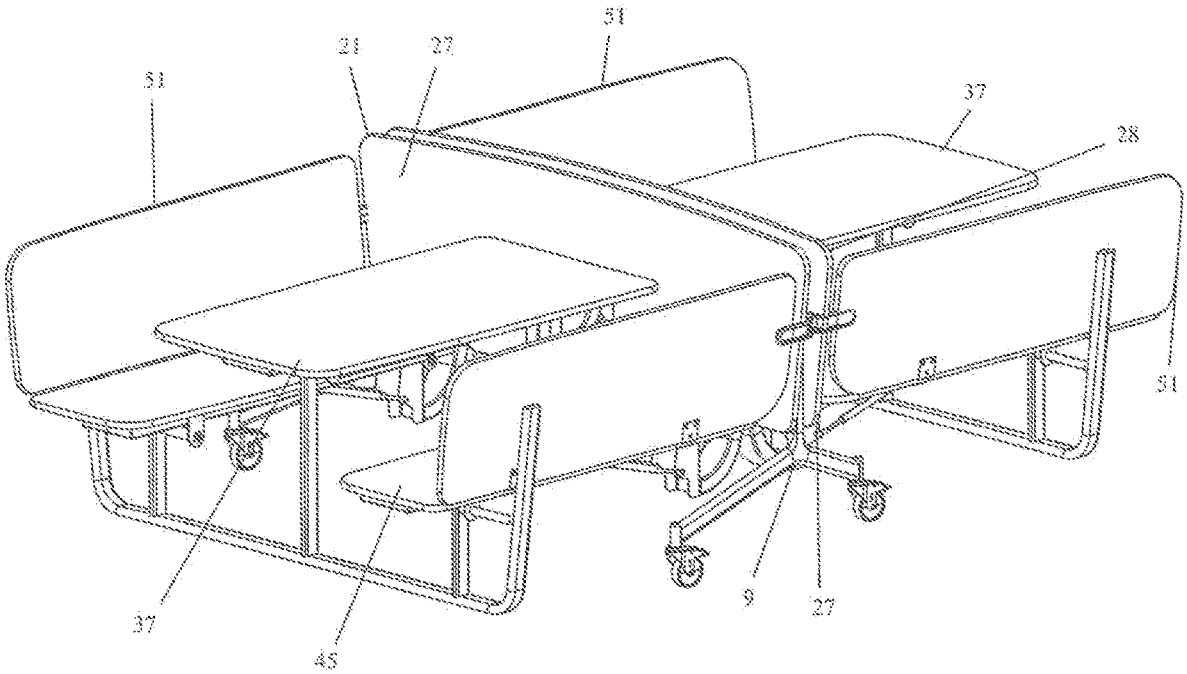
FIG. 15 is a perspective view of an alternative configuration for the booth.
Figure 16:
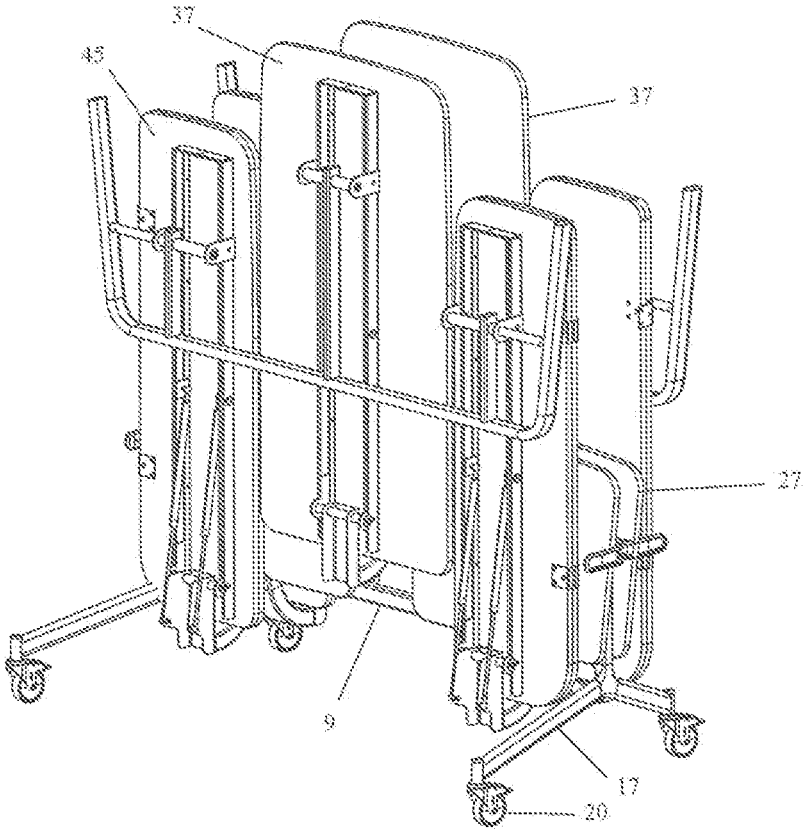
FIG. 16 is a perspective view of the booth of FIG. 15 in the storage position.

As shown in FIGS. 13 and 14 the seatback 81 can be pivotably secured to the back panel 21 or base frame 9 by a hinge 83. The hinge is designed so that the seatback 81 can be folded over the second side 40 of the table 37 when the bench 45 is in the stored position. The seatback 81 and the back panel 21 can be upholstered if desired. FIGS. 15 and 16 show another feature of the booth of the present invention. In this configuration two back panels 21 are positioned in adjacent relationship. A table 37 and a bench 45 are pivotably secured to the first surface 27 of each back panel 21. A table hinge 31 and bench hinge 41 are positioned on the first surface of each back panel to connect the table and bench to the back panel. Seatback 51 can be secured to each of the benches 45 in the manner previously described. The components of the booth can be disposed in a use position as shown in FIG. 15 and a storage position as shown in FIG. 16. This configuration provides a double booth arrangement that extends the ways that the booth can be used while still providing easy move ability and storage for the double booth arrangement. The other features and components for the double booth arrangement shown in FIGS. 15 and 16 are as previously described in this application. As shown in FIGS. 7 and 8 a plurality of booths 5 and double booths can be nested together when the table and benches that are that part of the booth are in the storage position.

Figure 17:
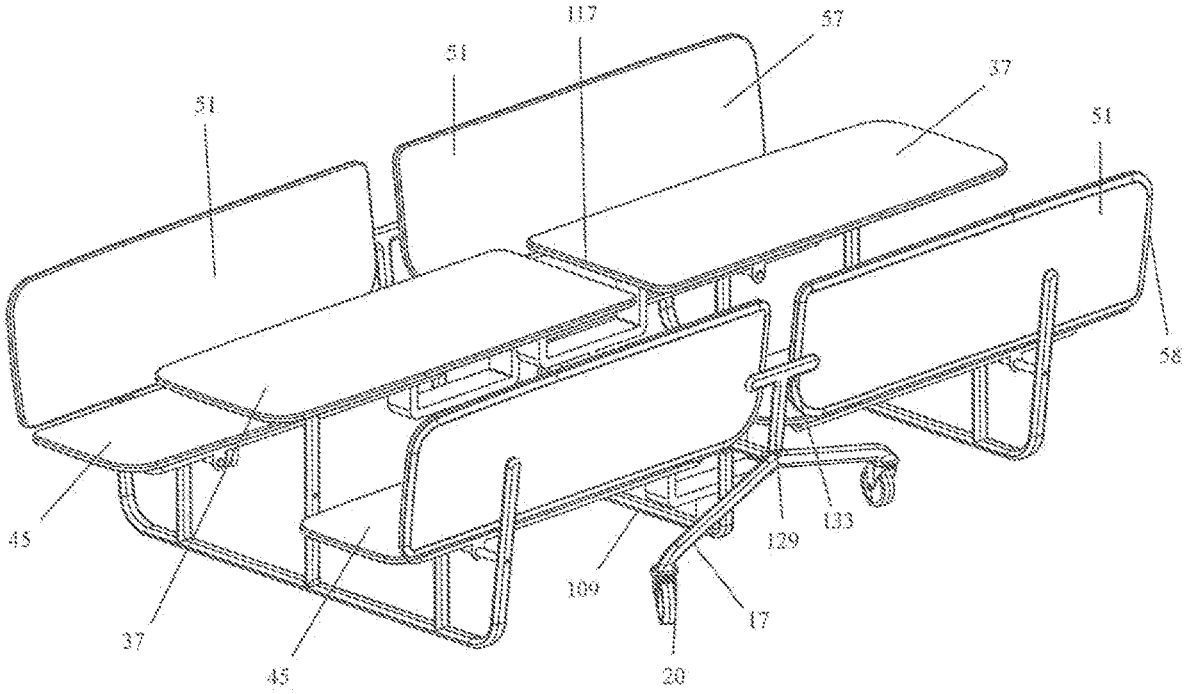
FIG. 17 is a perspective view of an alternative configuration for the booth.
Figure 18:
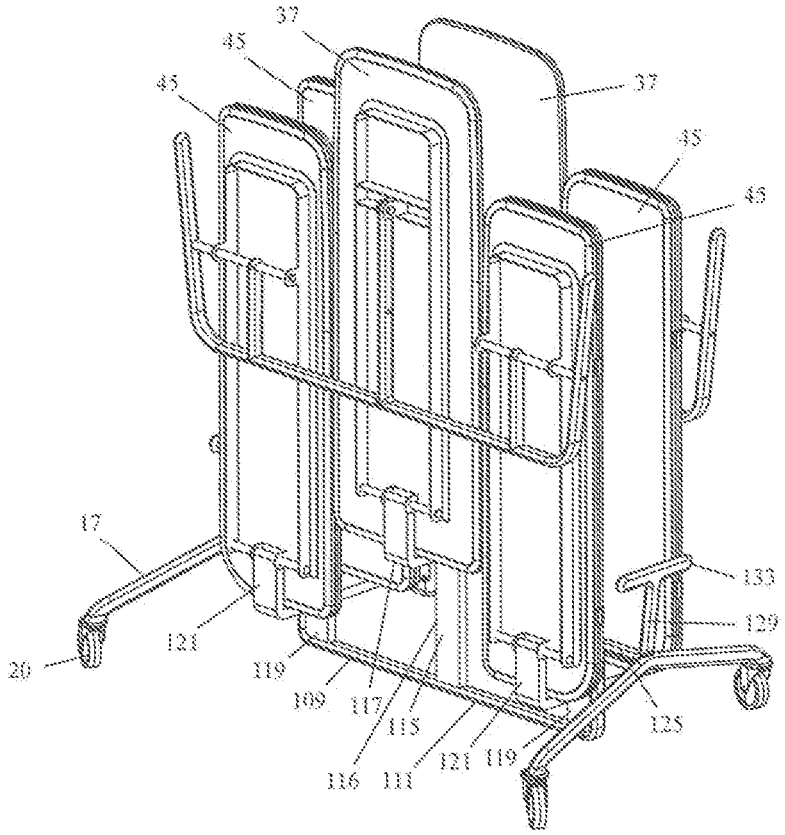
FIG. 18 is a perspective view of the booth of FIG. 17 in the storage position.

FIGS. 17 and 18 show another arrangement for a double booth product. A base frame 109 has a base 111 that is designed to engage the surface upon which the double booth is positioned. A first table support leg 115 and a second table support leg 116 are connected to the base and extend in a in a direction that is substantially perpendicular to the base. A double table hinge 117 is mounted on the end of the first and second table support legs that are spaced apart from the base 111. A table 37 is pivotably connected to each side of the double table hinge 117. A bench support leg 119 is connected to the base 111 on each side of the table support legs. The bench support legs extend in a direction that is substantially perpendicular to the base. A double bench hinge 121 is mounted on the end of each of the bench support legs that are spaced apart from the base 111. A bench 51 is pivotably connected to each side of the double bench hinge 121. A stabilization member 125 is disposed to extend from each bench support leg in a direction that is substantially perpendicular to the bench support legs. The stabilization member extends from each of the bench support legs 119 in a direction away from the table support legs. A seatback member 129 is connected to the end of the stabilization member 125 that is spaced apart from the bench support leg 119. The seatback member is disposed to extend in a direction substantially perpendicular to the stabilization member. A support 133 is positioned on the end of the seatback member that is spaced apart from the stabilization member 125. The support 133 is positioned to extend in a direction that is substantially perpendicular to the seatback member. The support 133 of the seatback member 129 is disposed to engage the second side 58 of the seatback 51 when the double booth is in the use position.

A table 37 is pivotably connected to each side of the double table hinge 117. A bench 45 is pivotably connected to each side of the double bench hinge 121 and a seatback 51 can be pivotably connected to each of the benches 45 in a manner previously described. A stabilization leg 17 is connected to each of the stabilization members 125. A caster 20 can be positioned on each end of the stabilization leg as previously described in this application. The double booth shown in FIG. 17 is in the use position and as shown in FIG. 18 is in the storage position. The other components of the double booth function as previously described in this application.

Figure 19:
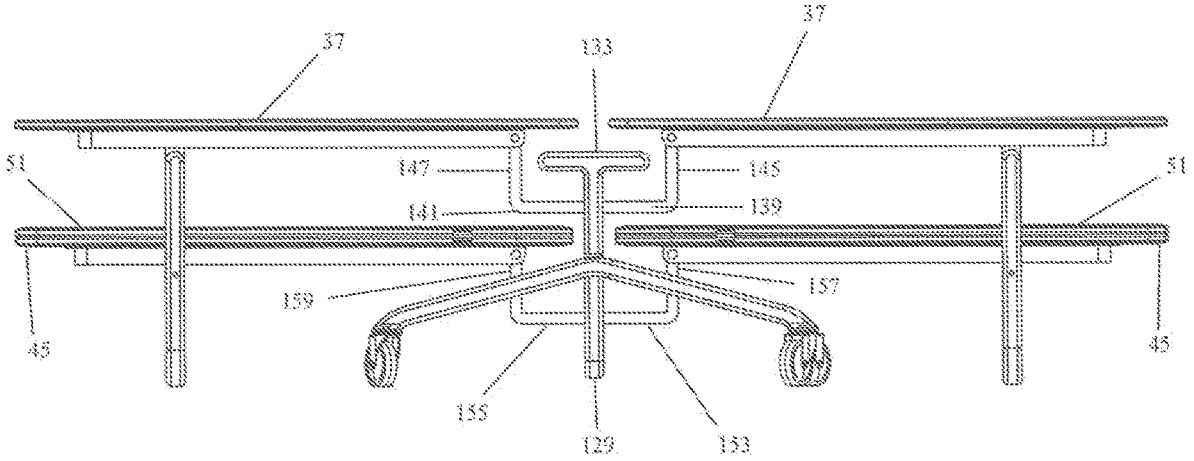
FIG. 19 is a side elevation view of the booth of FIG. 17.
Figure 20:
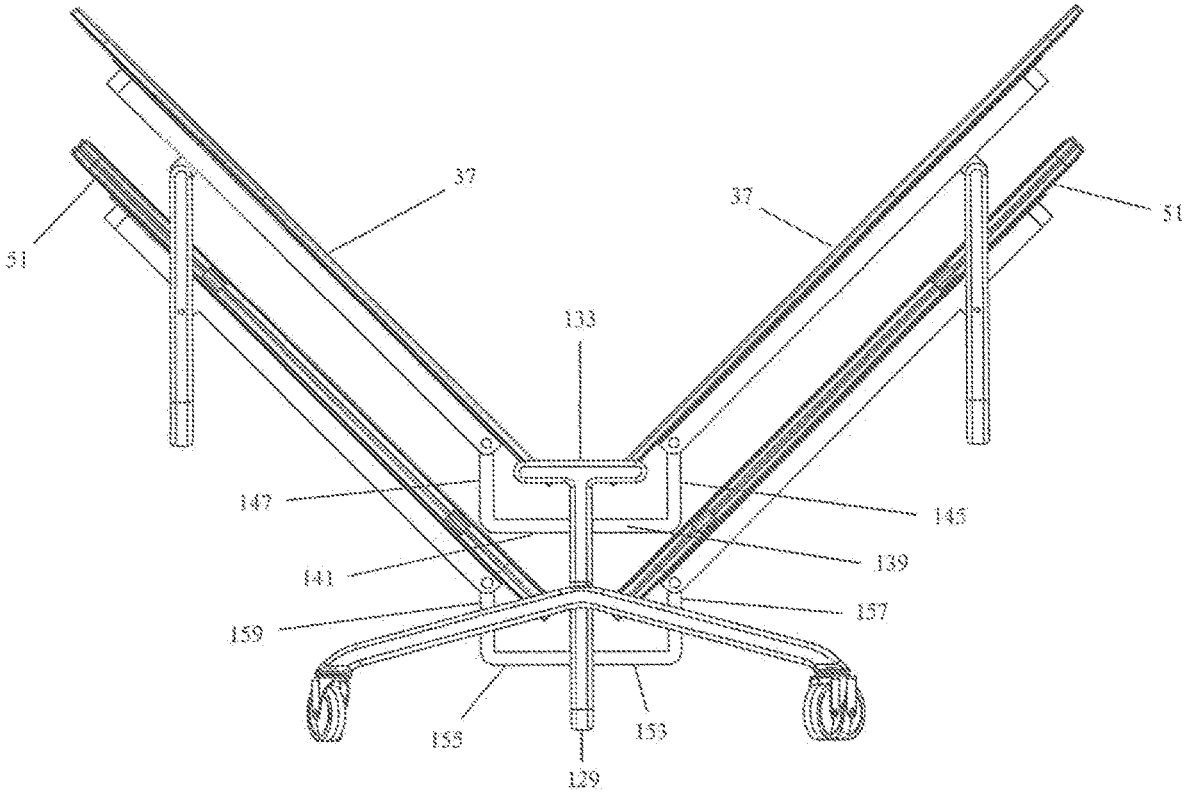
FIG. 20 is a side elevation view of the booth of FIG. 19 in a partially folded position.
Figure 21:
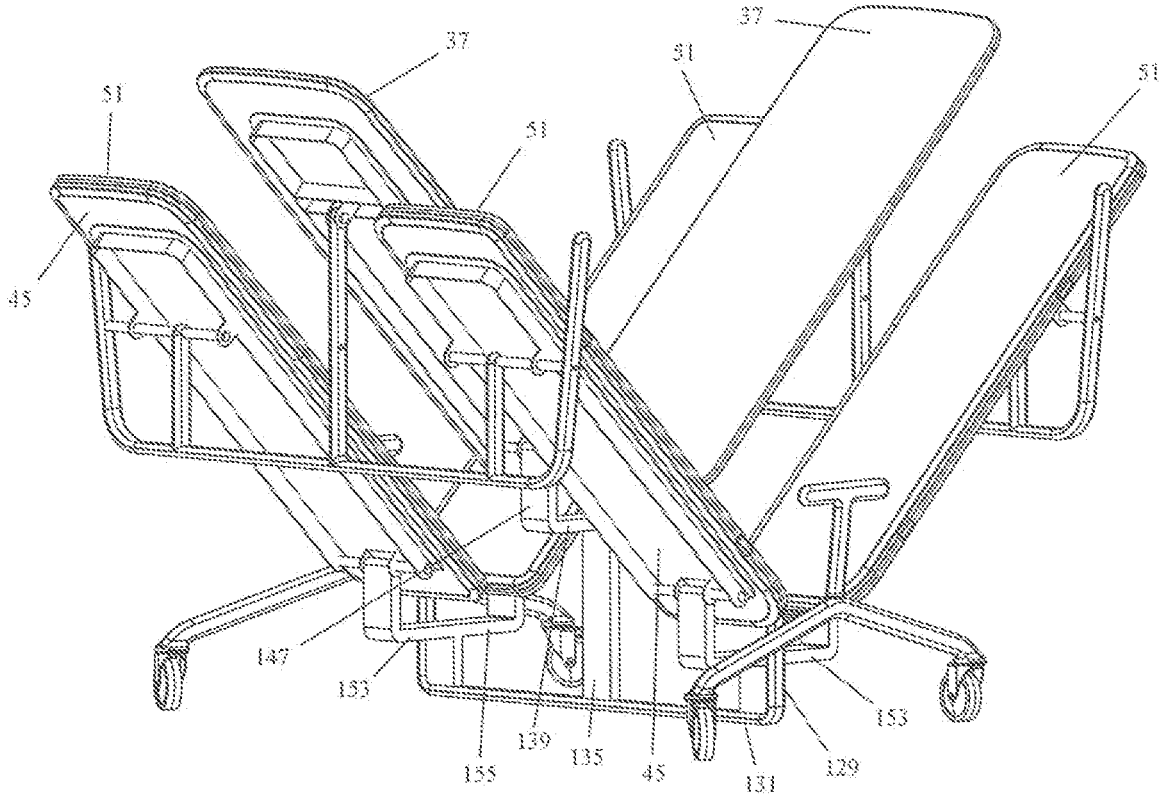
FIG. 21 is a perspective view of the booth of FIG. 19.

FIGS. 19, 20 and 21 show another version of a double booth that is similar to the concept shown in FIGS. 17 and 18. In this version of the booth, the base frame 129 has a base 131 that engages the surface upon which the double booth is positioned. A first table support leg 135 is connected to the base and extends in a direction that is substantially perpendicular to the base. A generally U-shaped table support member 139 having a support base 141 is positioned on the end of the table support leg that is spaced apart from the base 131. The support base is disposed in a substantially perpendicular relationship with the table support leg. A first leg 145 and a second leg 147 extend from the opposite ends of the support base in a direction that is substantially perpendicular to the support base. A table 37 is pivotably connected to the ends of the first leg 145 and to the second leg 147 that are spaced apart from support base 141. A bench support leg 151 is connected to the base 131 on each side of the table support leg 135. The bench support leg extends in a direction that is substantially perpendicular to the base. A generally U-shaped bench support member 153, having a support base 155, is positioned on the end of each bench support leg that is spaced apart from the base 131. The support base 155 is disposed in a substantially perpendicular relationship with the bench support leg. A first leg 157 and a second leg 159 extend from opposite ends of the support base in a direction that is substantially perpendicular to the support base. A bench 51 is pivotably connected to the ends of first leg 157 and the second leg 159 that are spaced apart from the support base 155. A back panel could be connected to the support base 141 and the support base 155 to provide a divider between the double booths. In all other respects the booth functions in the manner previously described.

FIGS. 1-3 and 24 show features of the hinges that connect the table 37 and the benches 45 to the back panel 21 or the base frame 9. The hinge 31, 41 has a first plate 233 and a second plate 235 that are positioned and spaced apart relationship. The base of the first and second plates are secured to a structural member of the base frame 9. A projection 241 extends from each plate and an aperture 245 extends through each projection. The aperture in the projection on the first plate 233 is in alignment with the aperture in the projection on the second plate 235. A rod 247 is positioned to extend between the two apertures 245 that are located in the first and second plates. A pivot member 255 is mounted on the ends of the rod 247 that extend from the first and second plates 233, 235. An opening 257 is provided in the pivot members 255 to receive the ends of the rod. A hole 259 is positioned in each pivot member. The pivot members 255 are disposed to engage a support bracket 261 positioned on the bottom of the table 37 and the benches 45. A plurality of openings 265 are provided in the support bracket and the plurality of openings are designed to align with the hole 259 in the pivot members 255. A suitable securing means such as a bolt and nut can be positioned in the hole 259 and one of the plurality of openings 265 to secure the table and benches to the pivot members 255 of the hinge 231. A recess 271 is positioned in the first and second plates adjacent to the projection 241. The recess is disposed to allow the end of the table and benches that are adjacent to the back panel 21 to move into the recess when the table and benches are positioned in the storage position adjacent the back panel.

Figure 25:
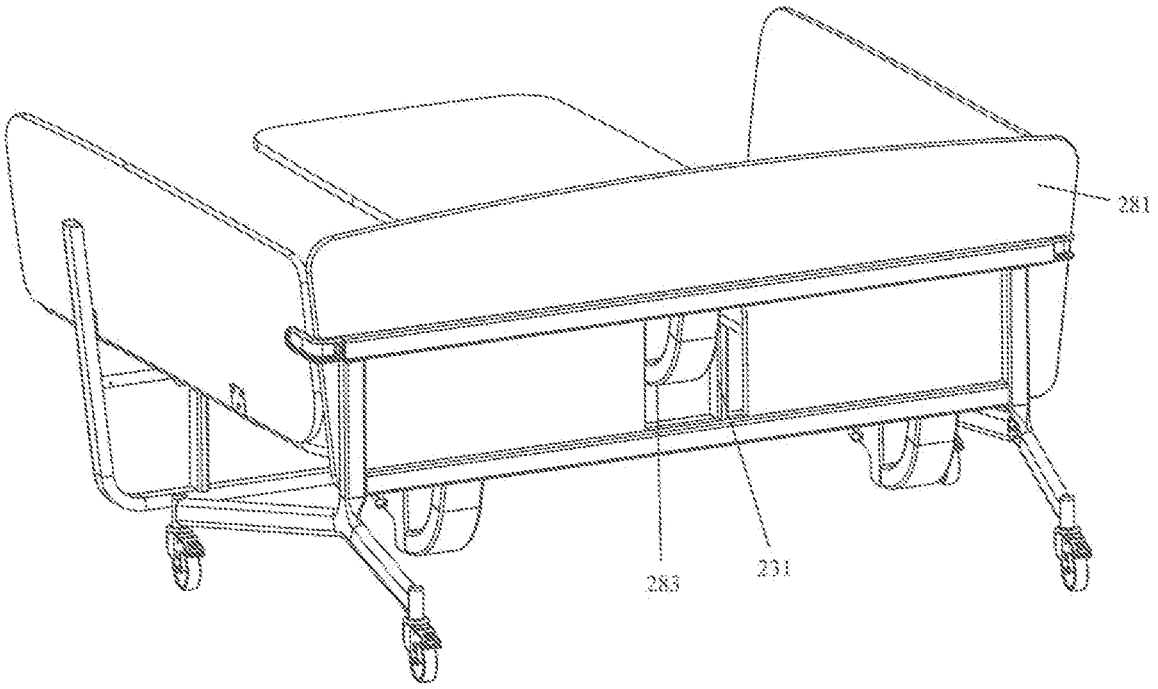
FIG. 25 is a perspective view of the booth.

As shown in FIG. 25, an opening 283 can be provided in the back panel 281 to provide space for the hinge 231. The hinge 231 secures the table 37 to the base frame 9.

The first end 273 of a hydraulic or pneumatic cylinder 275 can be connected to the first plate 233, the second plate 235 or to both the first and second plates. The second end 277 of the cylinder is connected to a support bracket 261 positioned on the bottom of the table 37 and or benches 45. The cylinder is disposed to provide a biasing force that assist in moving the table 37 and benches 45 from an in-use position to a storage position where the table and benches are adjacent the back panel 21. The hydraulic or pneumatic cylinder can also provide resistance that slows the movement of the table and benches from the storage position adjacent the back panel 21 to the in-use position where the table and benches are disposed substantially perpendicular to the back panel. The number of hydraulic or pneumatic cylinders that are utilized is dependent upon the size of the cylinders and the weight of the table and benches. It should be noted that a coil spring or torsion spring could be used to provide the biasing force and resistance in place of the hydraulic or pneumatic cylinder. The coil or torsion springs would be stretched when the table and benches were moved from the storage position to the in-use position. The energy stored in the coil or torsion springs would be available to provide a biasing force to assist in moving the table and benches to the storage position adjacent the back panel 21.

Figure 26:
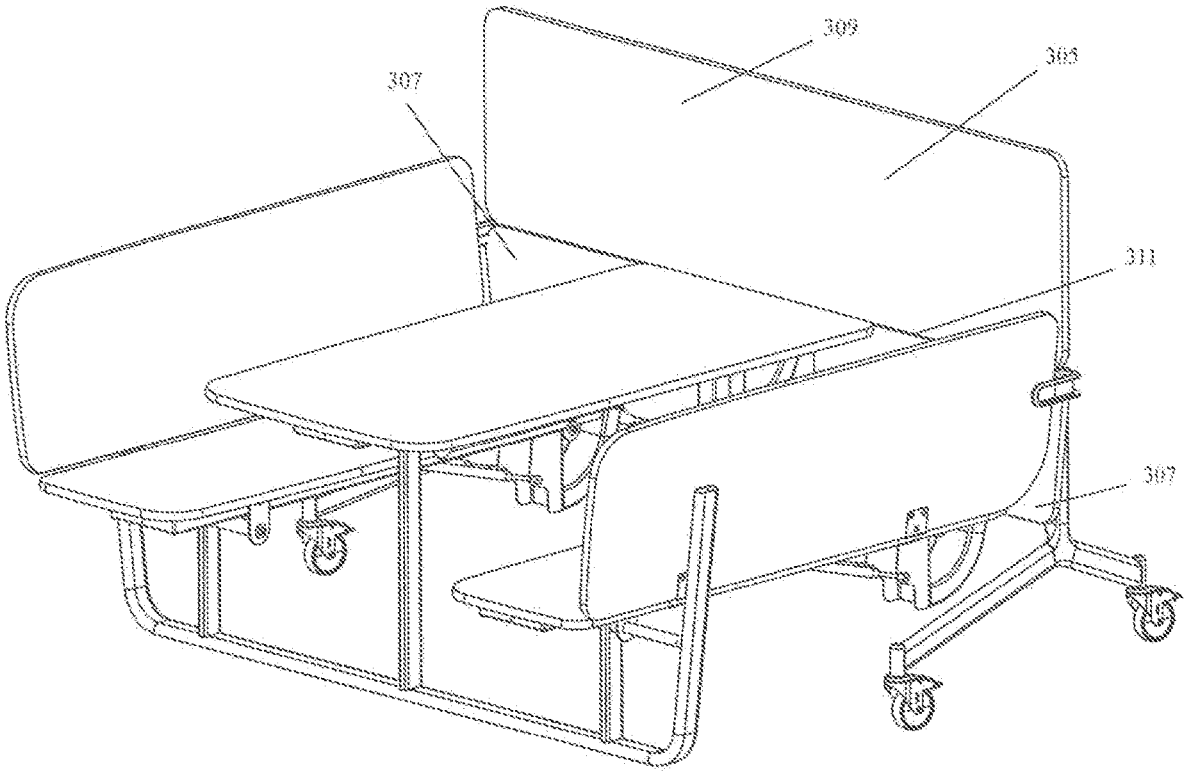
FIG. 26 is a perspective view of an alternative configuration of the booth in the stored position.
Figure 27:
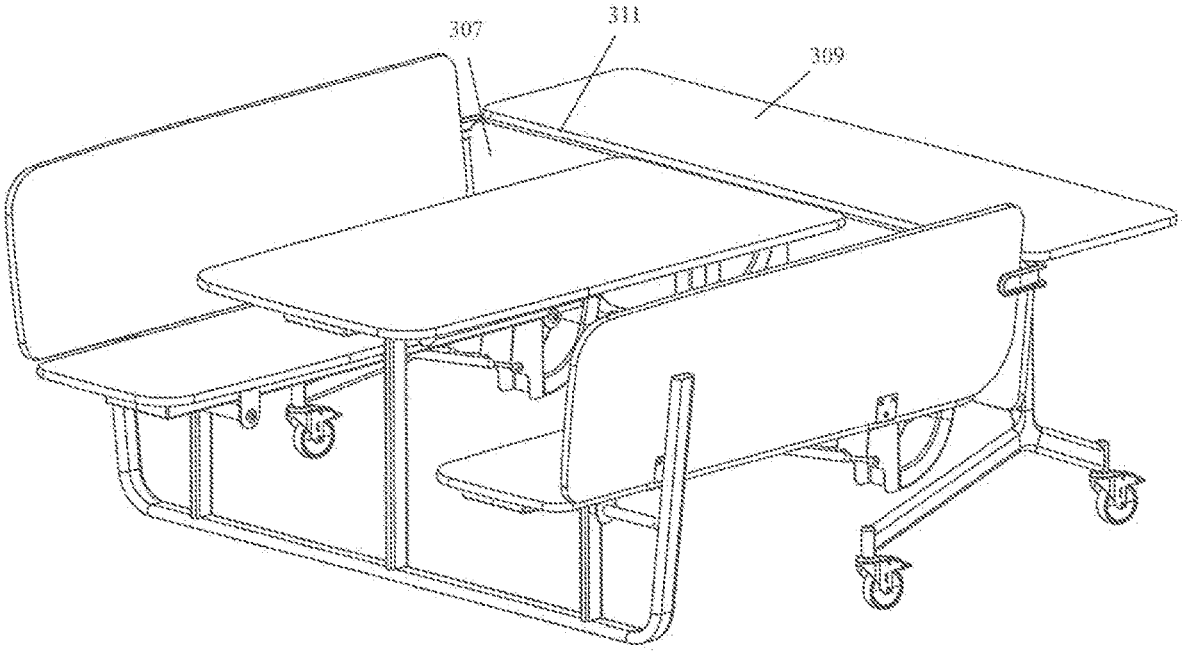
FIG. 27 is a perspective view of the booth of FIG. 26 in the deployed position.
Figure 28:
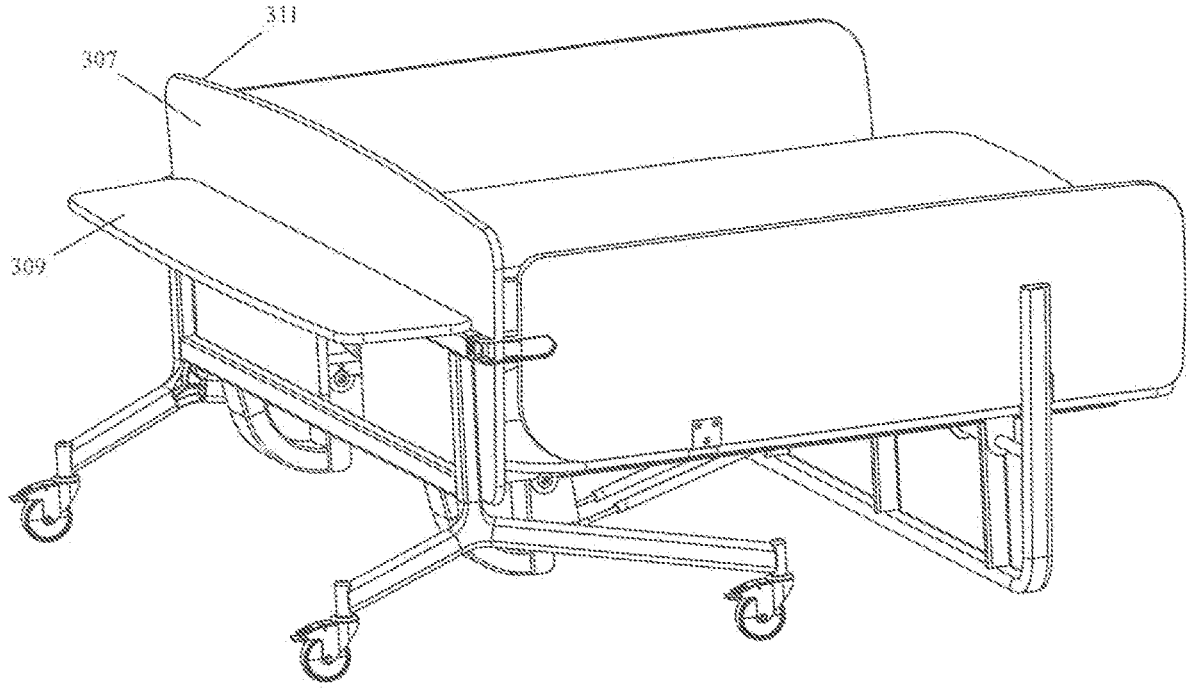
FIG. 28 is a perspective view of an alternative configuration of the booth in the deployed position.
Figure 29:
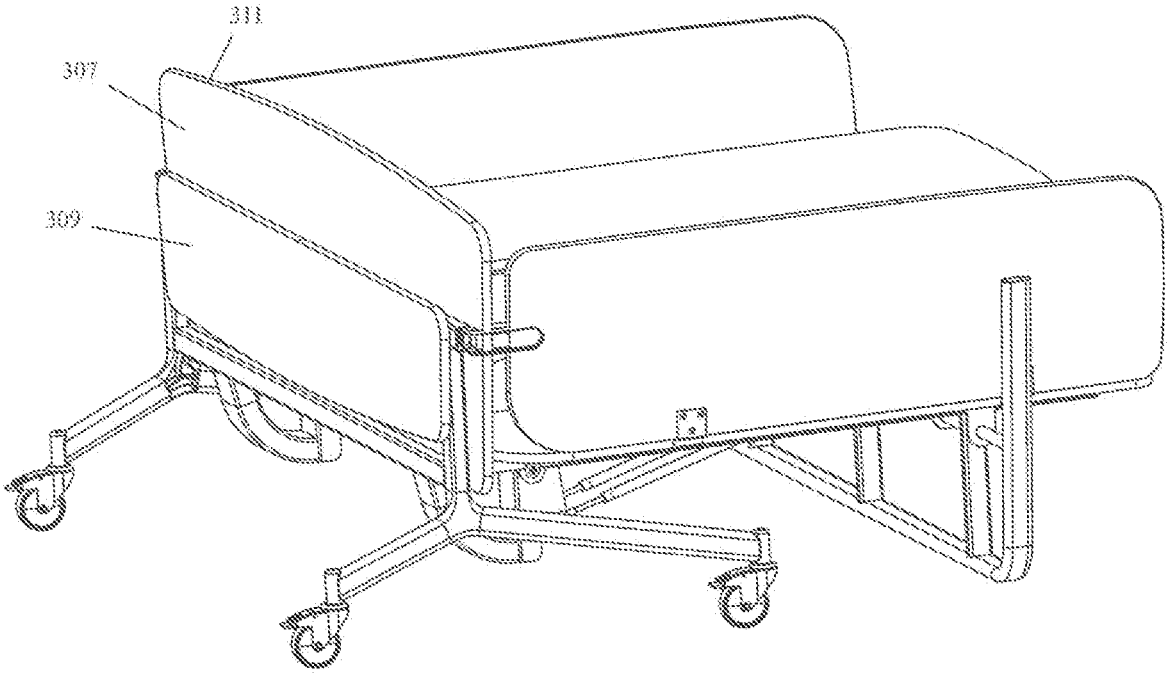
FIG. 29 is a perspective view of the booth of FIG. 28 in the stored position.

FIGS. 26 and 27 shown an additional feature of the invention. The back panel 305 of the booth can have a lower section 307 and an upper section 309. The upper section is hingeably connected to the lower section by a suitable hinge as previously described in this application. The upper section can be positioned so that it is in the same plane as the lower section, and this extends the height of the back panel to provide privacy or separation from other activities. The upper section 309 can also be positioned substantially perpendicular to the lower section 3407 to allow the upper section to function as an additional table. A securing device can be used to hold the upper section in this position, horizontal to the lower section. The upper section can also be pivoted to be adjacent the lower section, as shown in FIG. 29, when it is not desired to utilize the upper section. As shown in FIGS. 28 and 29, the upper section 309 can be hingeably secured to the lower section 307 at a position that is below the upper edge 311 of the lower section 307. This allows the upper section to be positioned at different heights when in the table position. The other features and components of the booths shown in FIGS. 26-29 are the same as previously described in this application.

The above detailed description of the invention is given for explanatory purposes. It will be apparent to those skilled in the art that numerous changes and modification can be made without departing from the scope of the invention. Accordingly, the foregoing description is to be construed in an illustrative, and not limited, sense, the scope of the invention being defined solely by the following claims.

We claim:

1. A booth comprising:

a base, the base having a first surface and a second surface;

a table having a first end, pivotally connected to the first surface of the base, the table movable from a stored position adjacent the base, to an in-use position;

at least one bench having a first end pivotably connected to the first surface of the base, the at least one bench movable from a stored position adjacent the base to an in-use position, the at least one bench having a first edge that is spaced apart from the table;

a seat back is pivotably connected to the first edge of the at least one bench, the seat back disposed to move from a storage position where a second edge of the seat back is adjacent the bench to an in-use position where the second edge of the seat back is spaced apart from the bench;

a support leg pivotably connected to a second end of the table and a second end of the at least one bench, the support leg disposed to extend in a direction perpendicular to the table and at least one bench engage a support surface when the table and at least one bench are in the in-use position, a portion of the supporting leg extends beyond the seat back, the position of the support leg disposed to engage the seat back to hold the seat back in the in-use position.

2. The booth of claim 1 wherein the base is a base frame having a top member, a bottom member and two side members, the two side members being connected to the top and bottom members.

3. The booth of claim 2 wherein the base is a back panel.

4. The booth of claim 3 wherein the back panel is positioned on the base frame.

5. The booth of claim 4 wherein the back panel is secured to the top, bottom and side members of the base frame.

6. The booth of claim 4 wherein the back panel has an upper section and a lower section, the upper section being hingeably connected to the lower section.

7. The booth of claim 6 wherein the upper section can be positioned to extend from the lower section in a direction to increase the height of the back panel.

8. The booth of claim 6 wherein the upper section can be positioned to extend from a side of the lower panel in a direction away from the table, the upper section being disposed substantially perpendicular to the lower section.

9. The booth of claim 6 wherein the upper section can be positioned adjacent a side of the lower section that is spaced apart from the table in a storage position.

10. The booth of claim 1 wherein a second table and at least one second bench are pivotably connected to the second surface of the base.

11. The booth of claim 10 wherein a support leg is pivotally connected to a second end of the second table and a second end of the bench.

12. The booth of claim 1 wherein the table and at least one bench are pivotably connected to the base with a hinge, the table and at least one bench being movably connected to the hinge to alter the position of the table and at least one bench with respect to the base.

13. The booth of claim 12 wherein the hinge has a recess that accommodates the position of the table and at least one bench with respect to the base.

14. The booth of claim 1 wherein a biasing means is operatively connected to the base and the table or the at least one bench, the biasing means providing a force to assist in moving the table and at least one bench to the stored position.

15. The booth of claim 1 wherein the at least one bench is releasably secured to the support leg whereby the at least one bench can be positioned in the stored position independently of the table.

16. The booth of claim 1 wherein the support leg is disposed to be adjacent the table and the at least one bench when the table and at least one bench are in the stored position.

17. The booth of claim 1 wherein a flange is positioned on the base, the flange disposed to engage the seat back to hold the seat back in the in-use position.

18. A booth comprising:

a base, the base having a first surface and a second surface; at least one stabilization leg is connected to each side of the base, the at least one stabilization leg connected to the base at a position adjacent the bottom of the base, the stabilization leg positioned on each side of the base has a first portion that extends in a direction towards the at least one bench and a second portion that extends in a direction away from the at least one bench, wherein the first portion has a length that is from about 30% to about 90% of the length of the at least one bench and the second portion has a length from about 20% to about 60% of the length of the at least one bench;

a table having a first end, pivotally connected to the first surface of the base, the table movable from a stored position adjacent the base, to an in-use position;

at least one bench having a first end pivotably connected to the first surface of the base, the at least one bench movable from a stored position adjacent the base to an in-use position;

a support leg pivotably connected to a second end of the table and a second end of the at least one bench, the support leg disposed to extend in a direction perpendicular to the table and at least one bench engage a support surface when the table and at least one bench are in the in-use position.

19. The booth of claim 18 wherein the first portion is positioned at an angle from about 55° to about 90° with a plane defined by the base.

20. The booth of claim 19 wherein the second portion is positioned at an angle from about 55° to about 90° with a plane defined by the base.

21. The booth of claim 20 wherein the first portion and the second portion extend in opposite angular directions from the base.

22. The booth of claim 21 wherein the first and second portions have an end that is spaced apart from the base, a caster being positioned on the end of the first portion and the end of the second portion.

23. The booth of claim 18 wherein the stabilization legs on the base are positioned in different distances from a centerline of the base.

24. A booth comprising:

a base, the base having a first surface and a second surface, wherein the base is a base frame having a top member, a bottom member and two side members, the side members being connected to the top and bottom members, wherein the base is a back panel and the back panel is positioned on the base frame, the back panel is positioned in a non-centered location on the base frame;

a table having a first end, pivotally connected to the first surface of the base, the table movable from a stored position adjacent the base, to an in-use position;

at least one bench having a first end pivotably connected to the first surface of the base, the at least one bench movable from a stored position adjacent the base to an in-use position;

a support leg pivotably connected to a second end of the table and a second end of the at least one bench, the support leg disposed to extend in a direction perpendicular to the table and at least one bench engage a support surface when the table and at least one bench are in the in-use position.

25. The booth of claim 24 wherein the back panel has a width that is oriented parallel to the top members of the base frame, the back panel having a center line that is disposed perpendicular to the top member, the center line of the back panel being displaced from a midpoint of the top member from about 0.75 inches to about 5 inches.

* * * * *